United States Patent [19]

Carpenter

[11] Patent Number: 4,983,137

[45] Date of Patent: Jan. 8, 1991

[54] DESIGN AND CONSTRUCTION TOY

[76] Inventor: Gene B. Carpenter, 420 E. Julian St., Savannah, Ga. 31401

[21] Appl. No.: 308,484

[22] Filed: Feb. 10, 1989

[51] Int. Cl.[5] ..... A63H 33/04

[52] U.S. Cl. ..... 446/69; 446/85

[58] Field of Search ..... 446/125, 124, 85, 69, 446/117, 227; D21/108; 434/211; 273/157 R, 156; 428/8, 49, 50, 33, 53; 40/617

[56] References Cited

U.S. PATENT DOCUMENTS

| | | | |
|---|---|---|---|
| 595,455 | 12/1897 | Glidden | 446/69 X |
| 3,815,282 | 6/1974 | Frost | 446/69 |

FOREIGN PATENT DOCUMENTS

| | | | |
|---|---|---|---|
| 660422 | 7/1929 | France | 446/69 |
| 2290626 | 6/1976 | France | 446/124 |

*Primary Examiner*—Mickey Yu

*Attorney, Agent, or Firm*—Griffin Branigan & Butler

[57] ABSTRACT

There is provided a design and construction toy having a plurality of relatively rigid elements, wherein each element has: a first side member and a second side member, with each of the side members having an outer face, an inner face, a top face and a bottom face, and the first side member and second side member are joined at ends thereof to form an apex and to provide a formed equilateral triangle with an open base; a predetermined distance between the outer face and the inner face, whereby a derived distance is established between the inner face and the outer face along the juncture of the joined ends at the apex; a lateral distance between the top face and the bottom face which is at least 0.1 and no more than 5.0 times the predetermined distance; and a height from the base to the apex of the formed equilateral triangle which is substantially equal to the height of a formed triangle having the greatest height, less an amount substantially equal to the sum of the said derived distances of all of the formed triangles having a greater height. With this arrangement, a plurality of the elements are nestable, outer face to inner face, and a nested plurality of the elements form an equilateral triangle.

16 Claims, 1 Drawing Sheet

DESIGN AND CONSTRUCTION TOY

The present invention relates to a design and construction toy, and more particularly to such a toy which has a plurality of elements of such configuration that the elements may be arranged by a playing child in a variety of fanciful designs and constructions.

BACKGROUND OF THE INVENTION

Educators nave long recognized that creative imagination by children during play is beneficial to the mental development of children. A variety of toys have been proposed in the art for allowing such creative imagination, and a number such toys have been in use for long periods of time. However, such conventional toys are generally constructed such that they are primarily intended for either design (novel, usually planar, arrangements) or construction (novel, usually three dimensioned, structures) by the playing child, and have limited utility in both design and construction. For example well known TINKER TOYS well configured for children, but those toys have little utility in creating new designs, e.g. arrangements of shapes and colors, by a playing child.

Another disadvantage of conventional toys is that in order to supply the child with a sufficient number of the individual elements making the toy to span the ability for design and construction of a wide range of ages of children, the cost of such a large number of such elements is quite high. Again, for example, a small number of TINKER TOYS elements is acceptable for very young children, e.g. to build small non-complicated structures, and the cost of that small number is reasonable. However, with older children, in order to challenge their creative imagination, a large number of elements would be required to build larger more complicated structures, e.g. windmills, and the cost of such a large number is quite expensive.

Another disadvantage is that when a relatively large number of elements of the toys is provided to children, the storage of the elements becomes burdensome, in view of the space required for that storage. Again, for example, a relatively large number of elements of TINKER TOYS for challenging the creative imagination of an older child will occupy considerable space.

A further disadvantage of conventional toys is that the small size of an individual element of toy is often such that it would be unsafe to allow unaccounted for elements to remain within the adventuresome reach of younger children, who could swallow those small elements. With the usual conventional toys, again for example TINKER TOYS, it is not possible to tell when all of the elements have been accounted for after play by a child, unless those elements are carefully inventoried and counted.

Some conventional toys obviate some of these disadvantages, while not obviating other of the disadvantages. For example, conventional toy blocks allow some degree of both design and construction, and can be stored in a container which will visually show if a block is missing. However, toys of this nature have very limited design and construction ability, and as a result thereof, such toys are acceptable for challenging the creative imagination of only young children.

In view thereof, the art has sought different geometric configurations of elements of such toys which will allow some connection of individual elements so that a reasonable degree of construction may be provided to the playing child, while at the same time providing some latitude for creative design. Interlocking blocks, such as that shown in U.S. Pat. No. 1,268,391, have been proposed in the art both for wall coverings, tiling and toys, but such blocks do not obviate the disadvantages noted above. It is also known in the construction industry that various geometric shapes may be interlocked for construction purposes, and U.S. Pat. No. 3,654,059, is representative thereof. However, such geometric shapes, again, do not solve the disadvantages noted above.

Other attempts at providing geometric shapes for play by children involve geometric puzzles, such as that shown in U.S. Pat. No. 4,561,097, but here again such puzzles composed of geometric shapes do not obviate the disadvantages noted above.

A step forward in the art in obviating these disadvantages is disclosed in U.S. Pat. No. 3,834,067, which discloses toy building blocks in a generally elongated V-shape with locking notches in lower side walls which will permit the V-shaped blocks to be stacked one on another. Also, by controlling the angle of these V-shaped blocks, the blocks can be nested, to an extent, to conserve storage space. While this approach in the art does obviate some of the disadvantages noted above, this approach is substantially only applicable to construction play and has very limited or no design utility for the playing child.

Accordingly, it would be of substantial advantage to the art to provide toys of the above-noted nature which have both construction and design capabilities for the playing child, are inexpensive to provide large numbers of elements for challenging a wide range of ages of children, occupy very little space in storage, and are easily visually accounted for when storing to ensure that no unaccounted for element might prove to be a safety hazard for younger children.

BRIEF DESCRIPTION OF THE INVENTION

The invention is based on three primary discoveries and several subsidiary discoveries. First of all, it was found that an equilateral triangle, i.e. a triangle with each angle being 60°, is a unique configuration for an element of a toy of the above-noted nature which will allow a plurality of those elements to be stacked in a construction configuration or arranged on a flat surface in a design configuration.

As a second primary discovery, it was found that the equilateral triangle of individual toy elements can be made in decreasing heights, i.e. distance from the base to the apex, such that an assembly of the individual equilateral triangle elements will form a nested configuration, which nested configuration, again, forms an equilateral triangle.

As a third basic discovery, it was found that with such an arrangement, when the toy elements are so nested for storage, it is quite apparent if any individual element is missing.

As a subsidiary discovery, it was found that the thickness of the side members of the equilateral triangle are important for allowing both design and construction capability. As a further subsidiary discovery, it was found that the thickness must be within a certain relationship to other dimensions of the side members of the equilateral triangle elements in order to preserve both construction and design capabilities.

Finally, as a subsidiary discovery, it was found that the nesting of elements for either design or storage purposes must be arranged so that the nesting can take place in a special relationship of the elements, one to the other.

BRIEF DESCRIPTION OF THE INVENTION

DETAILED DESCRIPTION OF THE INVENTION

Figure 1:
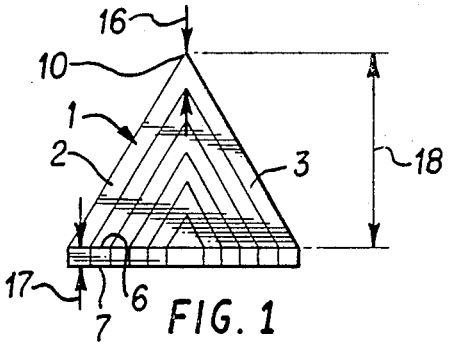
FIG. 1 is a perspective view of a plurality of individual toy elements in a nested configuration.

As noted above, the present invention is concerned with a design and construction toy. The toy comprises a plurality of relatively rigid elements, generally, 1. Each element has a first side member 2 and a second side member 3. Each of the side members have an outer face 4, an inner face 5, a top face 6 and a bottom face 7 (see FIG. 2). The first side member 2 and the second side member 3 are joined at the ends thereof to form an apex 10 and to provide an equilateral triangle with an open base, generally, 11 (see FIG. 2). In this regard, of course, the term "open base" means that the triangle has no base side member but is simply open on the base side of the triangle. In other words, the element is a triangle with an open base or simply an angle. It should also be appreciated that all of faces 4, 5, 6 and 7 are shown in the drawing as flat faces, i.e. the four faces of one side member of the triangle form a side member with a rectangular cross-section. It should be appreciated, however, that these faces need not be flat and hence the cross-section need not be rectangular, but both for ease of manufacture and for use of the toy, it is preferred that each of these faces, in fact, be flat.

There is also a predetermined distance (shown by arrows 15—see FIG. 2) between outer face 4 and inner face 5. The exact length of this predetermined distance is discussed hereinafter. In view of the predetermined distance 15 between the outer face 4 and the inner face 5, there will be a derived distance (shown by arrows 16—see FIG. 1) established between the inner face 5 and the outer face 4 along the juncture of the joined ends of the side member 2 and 3 at the apex 10. This derived distance will be set by the predetermined distance between faces 4 and 5, since the derived distance is automatically derived (set) by the intersection of side members 2 and 3 at apex 10. Thus, the derived distance is derived in the sense that it is an automatically derived distance as a function of the predetermined distance. This derived distance will remain the same, even if the apex 10 is flattened so as to form a frustum, for the reasons explained below in regard to the nesting of the elements.

There is also a lateral distance (shown by arrows 17—see FIG. 1) between the top face 6 and the bottom face 7. This lateral distance 17 is at least 0.1 but no more than 5.0 times the said predetermined distance 15. These relationships between the distances are necessary in order to allow the toy elements to function both in construction and design play. If, for example, the lateral distance 17 is much greater, e.g. ten times the predetermined distance 15, then the element 1 would be in something of a tent shape and would not be amenable to any reasonable use in design layouts, although it would be useful in a construction toy, somewhat in the manner as described in U.S. Pat. No. 3,834,067, discussed above. However, it has been found that the lateral distance 17 between the top face 6 and the bottom face 7 is far more preferably between about 0.6 and 1.2 times the predetermined distance 15, since within these ranges, there is still sufficient surface area for considerable construction by a playing child and at the same time allows the elements 1 to be arranged in various designs by the playing child. Even more preferably, in this regard, it is preferred that all of the faces have a planar configuration, i.e. a flat configuration, and that both side members 2 and 3 of the triangle have a rectangular cross-section, e.g. a square cross-section, since this provides the best combination of the ability of the elements for construction and design by a playing child.

In order to obviate the disadvantages, noted above, of more conventional toys of this nature, the height of the formed triangle of each element (shown by arrow 18 in FIG. 1) is critical. The formed triangle is, of course, the triangle formed by side members 2 and 3 joined along the ends thereof at apex 10 which is, as noted above, an angle of an equilateral triangle. Each element will have height 18 of that formed triangle which is substantially equal to the height of a formed triangle having the greatest height, less an amount substantially equal to the sum of the derived distances, as explained above, of all of the formed triangles having a greater height 18. This can be illustrated by reference to FIG. 2. Thus, a particular element 20 which has, of course, a formed triangle will be substantially equal to the height of the formed triangle having the greatest height, which in the case of FIG. 2 is element 21, less an amount substantially equal to the sum of the derived distances of all the formed triangles having a greater height, which in the case of FIG. 2 will be the derived distances of elements 22 and 23.

Figure 4:
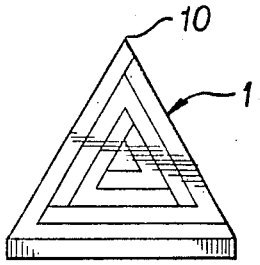
FIG. 4 is a perspective view showing an alternative arrangement for nesting of the toy elements.

By so arranging the heights 18 of individual elements, the elements are therefor nestable, outer face to inner face, as shown in FIG. 1 or in FIG. 4, and a nested plurality of those elements will form an equilateral triangle as also shown in FIGS. 1 and 4. Without the height 18 being so configured, the nestings shown in FIGS. 1 and 4 are not possible, and nestings, such as that shown in U.S. Pat. No. 3,834,067, noted above, will result.

It will be appreciated, however, that while greatly preferred, the apex 10 need not be angular, but can, in fact, be rounded or even flattened in a frustum shape. However, a rounded or flattened apex will somewhat decrease the construction ability of the toy and to some extent interfere with the design ability of the toy. It is, therefore, far preferable that the outer face 4 and the inner face 5 of both side members 2 and 3 at the apex 10 form an angle.

Figure 2:
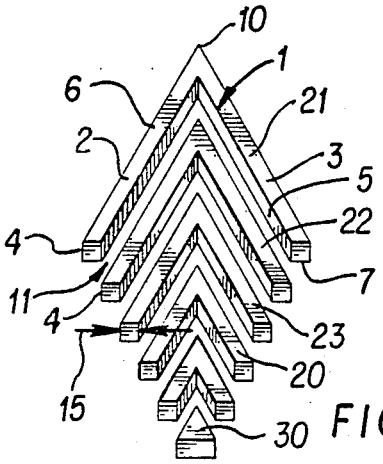
FIG. 2 is an exploded view of FIG. 1.
Figure 5:
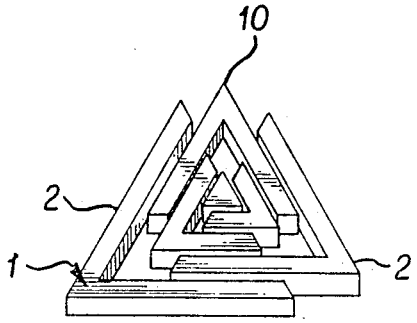
FIG. 5 is an exploded view of FIG. 4.

While some deviation is possible in connection with the open base 11, it is preferred that the open base 11 is entirely open between the first side member 2 and the second side member 3, as shown in FIG. 2, in order to ensure that the nesting will be precise, as that shown in FIGS. 1 and 4.

Figure 3:
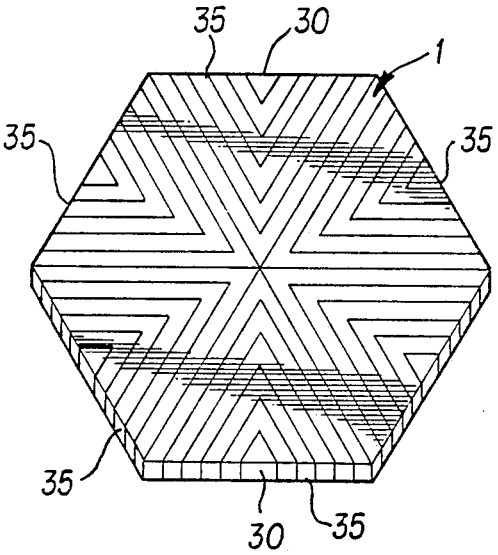
FIG. 3 is a perspective view showing a plurality of nests of nested toy elements arranged for storage purposes.
Figure 6:
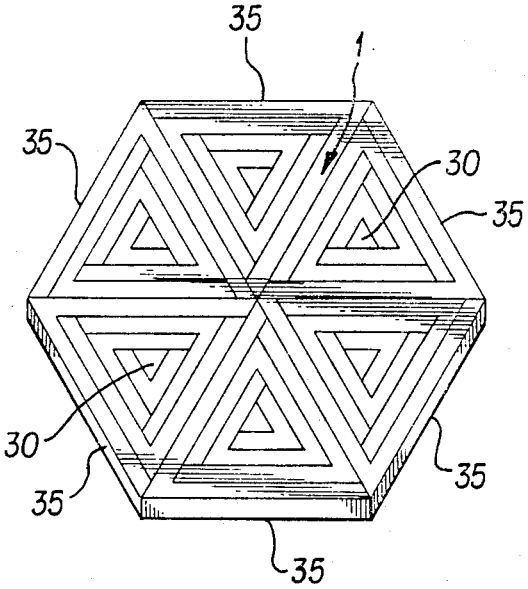
FIG. 6 is a perspective view of the alternative arrangement of nests of nested toy elements, as shown in FIG. 4, for storage purposes.

It will be appreciated from the description of element 1, above, and from the description of the open base 11, above, that when the elements are nested, as shown in FIGS. 1 and 4, there will remain an open base in the last (smallest height) nested element. Preferably, therefore, there is a further element 30 (see FIGS. 1 and 2) and that further element is in the configuration of an equilateral triangle having sides and a base such that the further element occupies the space of the open base of the smallest height element in the group of nested elements. This further element 30 not only completes a pleasing appearance, when the elements are nested or when a plurality of nests of nested elements are provided, as shown in FIGS. 3 and 6, but also is useful in both design and construction play of the child for producing variations in the constructions and designs.

As noted above, an important feature of the invention is the ability to conserve space for storage and to ensure that all of the toy elements are collected for storage, in order to avoid possible safety hazards. As can be seen from FIGS. 3 and 6, the present elements, nested in a manner shown in either FIGS. 1 or 4, can be formed into a plurality of nests of nested elements and are arranged in a nested configuration such that the nested configuration has six equal sides 35, which is a result of the equilateral triangular shape of the elements and nests of elements. When the nested elements also include the further element 30, the plurality of nests of nested elements are also arranged so that the nested configuration has six sides and in addition all of the space within the six sides is fully occupied by an element. By this arrangement, when storing the toys, the plurality of nests of nested elements will occupy a minimum space and only a casual glance at the nest of nested elements will ensure that all of the elements have been retrieved for storage and there is no safety hazard from a lost or unaccounted for element. The nest of nested elements for storage is also pleasing for children to construct and encourages children to store the elements after play.

The elements 1 may be of any desired size, so long as the size is manageable by a playing child. Generally speaking, however, the length of a side of an element will be no more than up to about twelve inches, but on the other hand the length of a side of an element should be at least one inch in order to ensure easy manipulation by the playing child, e.g. about ten inches or 6 inches but more than 1.5 inches or 2.0 inches. Likewise, in order to ensure that the elements are of sufficient thickness to be easily manipulated by a playing child, it is preferred that the predetermined distance 15 be at least from about 0.2 inch to about 2.0 inches, e.g. 0.3 or 0.5 to 1.0 or 2.0 inches, and that the lateral distance 17 is from about 0.6 to 1.2 times the predetermined distance, but usually more nearly equal to the predetermined distance.

All of the elements may be of a single color, but it is preferred that at least some of the elements be of different colors, so that color coordination can be used by the playing child in creating constructions and especially designs. In order to ensure that construction is easily possible by even a young playing child, the elements must be relatively rigid, so as to support construction and manipulation. For this purpose, it is preferred that the elements be made of wood or of a rigid plastic, although heavy cardboard and composition materials may be used.

The present toy is amenable to a wide range of constructions and designs by the playing child. Fanciful animals and an almost infinite variety of such constructions and designs are possible with the present toys. The toys are simple and easy to manufacture, can be stored in a minimum of space, and are easily amenable to a visual confirmation that all toy elements have been accounted for when storing. Accordingly, it can be seen that the present invention obviates the disadvantages, noted above, in connection with prior art toys of the present nature, and provides a substantial advantage to the art.

What is claimed is:

1. A design and construction toy comprising a plurality of relatively rigid elements, each element having:

(1) a first side member and a second side member, with each of said side members having an outer face, an inner face, a top face and a bottom face, and the first side member and second side member being joined at ends thereof to form an apex and to provide a formed equilateral triangle with an open base and wherein the height from the base to the apex is different for each said element;

(2) a predetermined distance between said outer face and said inner face whereby a derived distance is established between the inner face and the outer face along the juncture of the said joined ends at the said apex;

(3) a lateral distance between said top face and said bottom face which is at least 0.1 and no more than 5.0 times the said predetermined distance; and (4) a height from the said base to the said apex of the said formed equilateral triangle which is substantially equal to the height of a formed triangle having the greatest height, less an amount substantially equal to the sum of the said derived distances of all of the formed triangles having a greater height;

wherein a plurality of the said elements are nestable, outer face to inner face, and a nested plurality of the said elements form an equilateral triangle and nests of nested elements are arrangeable in a nested configuration such that the nested configuration has six equal sides.

2. The toy of claim 1 wherein the said lateral distance between the top face and the bottom face is 0.6 to 1.2 times the said predetermined distance.

3. The toy of claim 1 wherein all of said faces have a planar configuration.

4. The toy of claim 3 wherein both of said side members have a rectangular cross-section.

5. The toy of claim 4 wherein the said cross-section is square.

6. The toy of claim 1 wherein the outer face and the inner face of both of said side members at the said apex form an angle.

7. The toy of claim 1 wherein the said open base is entirely open between said first side member and said second side member.

8. The toy of claim 7 wherein there is a further element and said further element is in the configuration of an equilateral triangle having sides and a base such that the further element occupies the space of the said open base of an element with the smallest height.

9. The toy of claim 8 wherein a plurality of nests of nested elements having a said further element are arranged in a nested configuration such that a nested configuration has six equal sides.

10. The toy of claim 1 wherein the said predetermined distance is from 0.2 to 2.0 inches and the said lateral distance is 0.6 to 1.2 times the said predetermined distance.

11. The toy of claim 1 wherein the elements are of a single color.

12. The toy of claim 1 wherein at least some of the elements are of different colors.

13. The toy of claim 1 wherein the said elements are made of wood.

14. The toy of claim 1 wherein the said elements are made of rigid plastic.

15. The toy of claim 1 wherein the length of a side of an element is up to 12 inches.

16. The toy of claim 15 wherein the length of a side of an element is at least 1 inch.

* * * * *

UNITED STATES PATENT AND TRADEMARK OFFICE

CERTIFICATE OF CORRECTION

PATENT NO. : 4,983,137

DATED : January 8, 1991

INVENTOR(S) : Gene B. Carpenter

It is certified that error appears in the above-identified patent and that said Letters Patent is hereby corrected as shown below:

Col. 1, line 12, change "nave" to --have--.

Col. 1, line 23, after "TOYS", insert --are--.

Col. 1, line 24, after "for", insert --construction, e.g. building towers, etc., by playing--.

Col. 1, line 29, after "making", insert --up--.

Col. 4, line 29, after "have", insert --a--.

Signed and Sealed this

First Day of December, 1992

*Attest:*

DOUGLAS B. COMER

*Attesting Officer*

*Acting Commissioner of Patents and Trademarks*